United States Patent [19]

Muschner

[11] Patent Number: 4,721,236

[45] Date of Patent: Jan. 26, 1988

[54] APPARATUS FOR MINIMIZING WEAR ON REFRACTORY PARTS FOR VALVE CLOSURES

[75] Inventor: Udo Muschner, Tönisvorst, Fed. Rep. of Germany

[73] Assignee: Didier-Werke AG, Wiesbaden, Fed. Rep. of Germany

[21] Appl. No.: 941,523

[22] Filed: Dec. 12, 1986

Related U.S. Application Data

[63] Continuation of Ser. No. 704,468, Feb. 22, 1985, abandoned.

[30] Foreign Application Priority Data

Feb. 25, 1984 [DE] Fed. Rep. of Germany ..... 3406941

[51] Int. Cl.[4] ..... B22D 41/00

[52] U.S. Cl. ..... 222/591; 222/603; 222/594

[58] Field of Search ..... 266/220, 236, 271

[56] References Cited

U.S. PATENT DOCUMENTS

| | | | |
|---|---|---|---|
| 3,330,645 | 7/1967 | DeMoustier et al. | 266/220 X |
| 3,838,798 | 10/1974 | Voss | 222/566 X |
| 4,241,905 | 12/1980 | Eiserman et al. | 222/597 X |

FOREIGN PATENT DOCUMENTS

| | | | |
|---|---|---|---|
| 2830209 | 6/1979 | Fed. Rep. of Germany . | |
| 2529493 | 6/1984 | France . | |
| 54-21533 | 7/1979 | Japan | 266/236 |
| 0152366 | 9/1982 | Japan | 222/600 |
| 57-152350 | 9/1982 | Japan . | |
| 1112907 | 8/1965 | United Kingdom | 222/591 |
| 1354041 | 5/1974 | United Kingdom . | |
| 2025018 | 1/1980 | United Kingdom . | |

*Primary Examiner*—Robert J. Spar
*Attorney, Agent, or Firm*—Nils H. Ljungman

[57] ABSTRACT

Refractory parts for valve closures include members which by mutual sliding or rotary action, interrupt the flow of molten metal from a metallurgical vessel. Closed reservoirs filled with an impregnation agent, for example tar, pitch, methane gas, are provided embedded in the refractory parts and disposed adjacent to refractory wearing surfaces which are susceptible to undergo depletion and wear. The impregnation agent, on being heated by molten metal, slowly releases hydrocarbons which percolate through the refractory pores to the refractory wearing surfaces to prevent premature wear to the refractory surface and to provide lubrication for the flow of molten material in contact with the refractory wearing surfaces. The impregnation agent can be replenished in the form of replaceable porous cartridges which can be inserted into the reservoirs. Alternatively, the reservoirs can be filled with refurbishing supplies of the impregnating agent through an external nipple or a charging lock which communicates with the embedded reservoirs.

12 Claims, 7 Drawing Figures

APPARATUS FOR MINIMIZING WEAR ON REFRACTORY PARTS FOR VALVE CLOSURES

This application is a continuation of U.S. application Ser. No. 704,468, filed on Feb. 22, 1985, now abandoned.

BACKGROUND OF THE INVENTION

1. Field of the Invention

This invention generally concerns replaceable refractory parts which come into contact with molten metal in a metallurgical process and, more particularly, to apparatus for minimizing wear on refractory elements such as plates and sleeves of gate valves which handle molten steel, wherein the refractory elements are slowly consumed by wear and need replacement eventually with new elements. The invention specifically concerns an arrangement for retarding the rate of wear of the consumable refractory elements such as refractory plates and sleeves for gate valves.

2. Description of the Prior Art

Pouring ladles for molten metallic material, especially molten steel, have associated maintenance problems in that the gate valves of refractory material provided on such pouring ladles wear out prematurely and need replacement. The problem is especially severe in the case of pouring ladles which are relatively of high capacity and which handle relatively high density molten metal at substantially high temperatures. Refractory gate valve plates, being porous, are infiltrated by molten metal through pores of the exposed surfaces of the gate valve plate. The infiltrating molten metal permeates the exposed refractory material causing it to breakdown. Molten metal also flows into narrow gaps present between precision ground working surfaces of the valve plate and a base plate which is pressed against the valve plate. Owing to the penetration of molten metal and the existing physical pressure between the valve plate and the base plate, the deterioration of the exposed refractory surfaces is accelerated. To alleviate the problem of severe and premature wear of the refractory parts, it is known in prior art to soak and cover the surfaces of the refractory parts with tar, or other hydrocarbon material, before putting the refractory parts into use in gate valves. The tar material would plug the open pores of at least the exposed refractory surfaces and impede the penetration of molten metal into the body of the refractory elements, thereby somewhat lengthening the useful life of the refractory elements. While the soaking treatment of refractory elements with tar would undoubtedly improve the useful life of the refractory elements, the problem still exists that the tar or hydrocarbon layer and material in the pores would be consumed relatively soon by evaporation, thus necessitating repeated and frequent treatment of the refractory elements or members. Repeated treatment of the refractory members with tar or similar material would necessitate an interruption of the operation of the pouring ladle of which the gate valve and the refractory members are a part. As is well known, frequent interruptions in the continuity of operation of the pouring ladle result in wasteful "downtime", thus rendering the entire process very uneconomical.

OBJECT OF THE INVENTION

It is an object of the present invention to provide a solution to the acute problem of having to interrupt the operation of the pouring ladle frequently in order to refurbish the refractory elements with tar. The invention ingeniously provides for replenishing the impregnation of the refractory members with tar whenever needed, at will, while not interrupting the continuity of operation of the steel pouring ladle.

SUMMARY OF THE INVENTION

The present invention in its broad form comprises a metal pouring ladle of the type having a gate valve for stopping flow of molten metal from the ladle in use, said gate valve comprising a refractory body including a passage for flow of molten metal, said refractory body being porous and having surfaces which are prone to depletion and wear by contact with flow of said molten metal; the gate valve includes an arrangement to minimize said wear of said refractory surfaces, the arrangement comprising repository means formed within said refractory body and disposed in proximity to said surfaces, said repository means including a supply of heat sensitive impregnation agent which will generate protective lubricants which penetrate the refractory pores to reach such refractory surfaces, whereby any wear of said refractory surfaces in use is minimized.

In a preferred form of the invention, a closed repository of tar, or other desired impregnating agent, is maintained in a reservoir which has a charging lock. The reservoir is in communication with the refractory members to be protected, and provides replenishing supplies in such manner that the replenishing supply is oriented towards the regions of the refractory members where refurbishing of the impregnating agent is needed. By providing such a reservoir or repository in association with a charging lock, any impregnating agent which gets consumed by evaporation from the refractory members can be steadily replenished in a timely fashion with no interruption of the process, thereby obviating the excessive "downtime" and enabling an economical operation because of the prolonged life of the refractory members. Thus, by using the present invention, a deleterious exposure and impregnation of the refractory members by molten metal is prevented for a longer time than is possible by known prior art arrangements.

In practice, with the prior art arrangements, it was found that deterioration of the surfaces of the refractory member took place in a two-stage process. First, the surface finish of the refractory element and the deposited tar layer of the refractory element or member would be destroyed, whereby a surface lubricating effect is lost. As an immediate consequence, the friction between the flowing molten metal and the refractory surface would increase, hastening and accelerating the destruction process.

By the provision of a steadily replenishing supply impregnating agent directed towards areas of the refractory members where the supply of impregnating agent is needed, the lubricating effect referred to hereinabove, and the continuity of operation are both maintained, whereby deleterious friction damage of the refractory members caused by flowing molten metal is avoided.

The location of the repository or reservoir, with respect to the refractory surfaces which have a tendency to wear out, is found to be very important and critical to the effective and efficient operation of the inventive arrangement. Certain portions of the refractory members, for example, the choke edges of the valve plate, are stressed in use by the molten metal with particularly high intensity. It is accordingly expedient to install the reservoir with its porous feed channels in such a manner that the more stressed regions of the refractory members get the better supply of impregnating agent, whereby a wear equalization of the entire refractory members is ensured.

Such a repository can, if necessary, also be located on the base plate of the gate valve, in which case a repository located in a sleeve is advantageously configured around the flow opening, the repository having a charging lock on a free end surface thereof. In this manner, infiltrating and corrosive effects of the molten metal on the refractory wall of the flow opening are effectively counteracted by the constant presence of hydrocarbons, and the life span of the refractory sleeve is significantly increased.

With specific regard to the repository apparatus, for purposes of dispensing the impregnation agent, the invention proposes the use of a stoppered closure as a charging lock, the repository containing a packing triggered open by heat. Such packing can, for example, be made of pitch which is solid at normal temperature, or the packing can comprise packed liquid hydrocarbons, for example, tar. The packing may comprise easily-flammable materials, such as paper, plastic, etc., which would have long since disappeared by the time the refractory parts have reached operating temperature. Both solid and dense liquid hydrocarbons can be mixed with refractory material, preferably highly-porous grains or ceramic fibers, to reduce the hydrocarbon concentration of the impregnation agent or to adjust it to a specified level.

Before placement in the gate valve, the refractory wearing part is preferably charged with the impregnation agent, and then the stopper closure is inserted, with cement or mortar, after ensuring that the quantity of impregnation agent corresponds to the desired and expected life span of the refractory wearing part. Otherwise, if the impregnation agent charged is of insufficient quantity, the stopper closure can advantageously be provided with a rapid-release connection, for example, a threaded connection, for reloading the impregnation agent.

For gate valve operation with refractory wearing parts with relatively long life expectancy, the invention proposes a repository which has a check valve as the charging lock and is preferably charged with liquid impregnation agents, but which can also be charged with gaseous impregnation agents. The check valve can advantageously be made in the form of a lubricating nipple, by means of which the repository can be filled, if and when necessary, by a manually operated injection gun or the like. It is also possible, however, to connect a feeding line to the check valve which delivers the impregnation agent. In both embodiments, the repository which can appropriately be filled with a highly-porous material, preferably ceramic fibers, can be put under a pressure which optimally creates a desired degree of capillary effect to fill the refractory pores and thus protect the refractory surfaces.

BRIEF DESCRIPTION OF THE DRAWINGS

A more detailed understanding of the invention may be had from the following description of a preferred embodiment, given by way of example only, and to be studied and understood in conjunction with the accompanying drawings in which.

DESCRIPTION OF THE PREFERRED EMBODIMENTS

Figure 1:
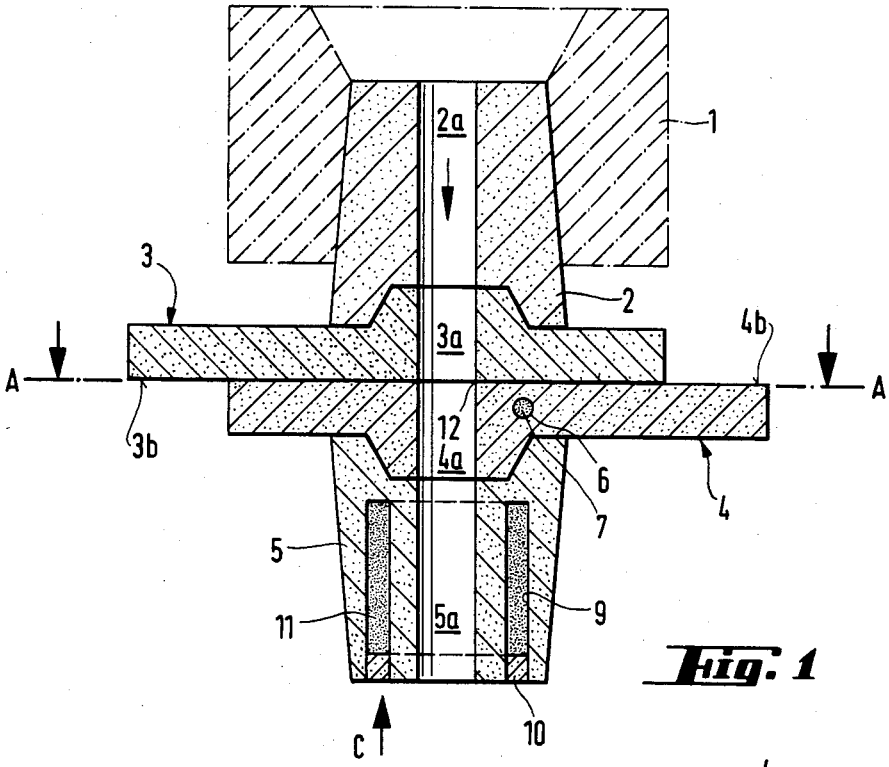
FIG. 1 shows in longitudinal section the wearing refractory parts of a linear gate valve in the open position.

As illustrated in the drawings, 1 designates the typical nozzle brickwork of a casting ladle, to which are connected the replaceable refractory parts of a gate valve lock, namely an inlet sleeve 2, a base plate 3, a valve plate 4 and an outlet sleeve 5. All the refractory parts 2 to 5 have flow openings respectively identified as *2a* to *5a*. In addition, the two plates 3 and 4 have work surfaces or friction surfaces *3b* and *4b* pressed against one another. The inlet sleeves 2 and the base plate 3 are rigidly fixed in place, but the valve plate 4 and the outlet sleeve 5 are supported in movable frames for opening and closing the valve lock.

Figure 2:
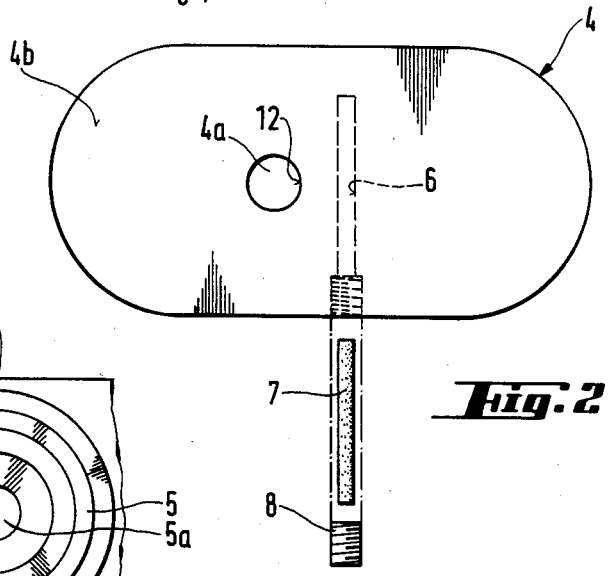
FIG. 2 shows an overhead view of the valve plate along Line A—A in FIG. 1 with the corresponding details.
Figure 3:
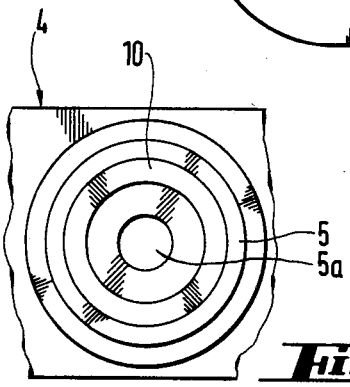
FIG. 3 shows a detail of FIG. 1 from a view along Arrow C.

As shown specifically in FIG. 2, the valve plate 4 is provided generally in its longer side at a region near the flow opening *4a* and below the work surface *4b*, with a repository in the form of a hole, designated as 6, which is loaded with a cartridge-type body 7 replete with impregnation agent; hole 6 can be closed with a stopper or charging lock 8. The outlet sleeve 5 is also equipped, as illustrated in FIG. 1, with a repository 9, which expediently has the shape of an annular chamber which runs around the flow opening *5a*. The repository 9 can be closed on its end by means of a ring-shaped stopper 10, and holds a ring-shaped body 11, which is replete with impregnation agent. The impregnation agent in both cases can comprise "pitch", for example.

Both repositories 6 and 9 and the impregnation agent cartridge bodies 7 and 11 therein, become hot in operation because of the molten metal, with the result that "pitch", which is solid at room temperature, melts, releasing hydrocarbons which evaporate to migrate outward from the network of cavities formed by the pores of the refractory material in the wearing refractory part. With the valve plate 4, this expediently takes place in the flat region of the choke edge 12 formed by the work surface *4b* and the wall of the flow opening *4a*, at the outlet sleeve 5 into the wall of the flow opening *5a*. At the above-mentioned region, the hydrocarbons which are evaporated by flowing molten metal during operation are immediately replaced by the hydrocarbons which are constantly migrating out of the repository 6 or 9, so that high-temperature liquid metal, for example, molten steel, is kept away from the open pores of the refractory wearing parts. Thus, wear caused by steel infiltration of the refractory parts is largely prevented. In addition, the hydrocarbons discharged from the work surface *4b* significantly reduce the friction between the two plates 3 and 4, when there is relative sliding movement therebetween.

Figure 5:
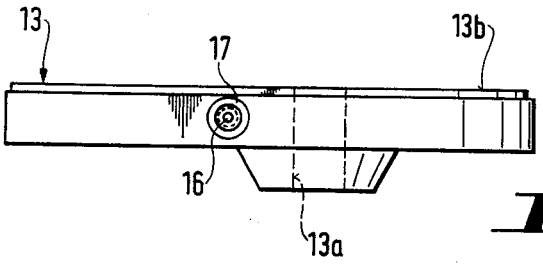
FIG. 5 shows the side view of FIG. 4.
Figure 4:
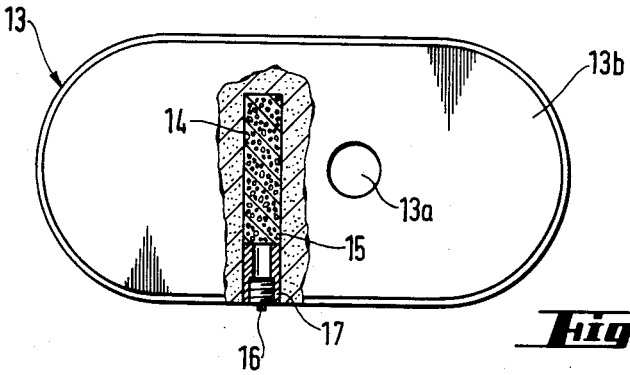
FIG. 4 shows an overhead view of the work surface of a valve plate with a partial exploded view showing details.

In a variation or modification, as illustrated in FIGS. 4 and 5, liquid or grease-like impregnation agents are used. For this purpose, the valve plate 13 below the long region of the work surface 13*b*, seen from the flow opening 13*a*, is equipped with a vertical repository 14. As shown, repository 14 has a porous refractory cylinder 15 and an orifice sleeve 17 equipped with a charging lock 16. By means of the charging lock 16 which may be in the form of a nipple, the repository 14 can be loaded and also reloaded, for example manually, by an injection gun, or the like.

Figure 7:
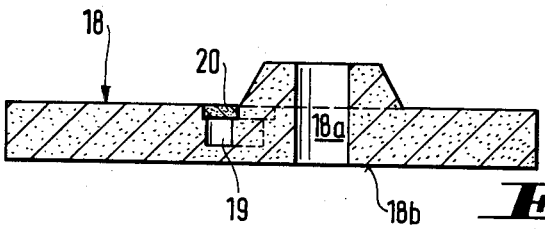
FIG. 7 shows a section along Line B—B of FIG. 6.
Figure 6:
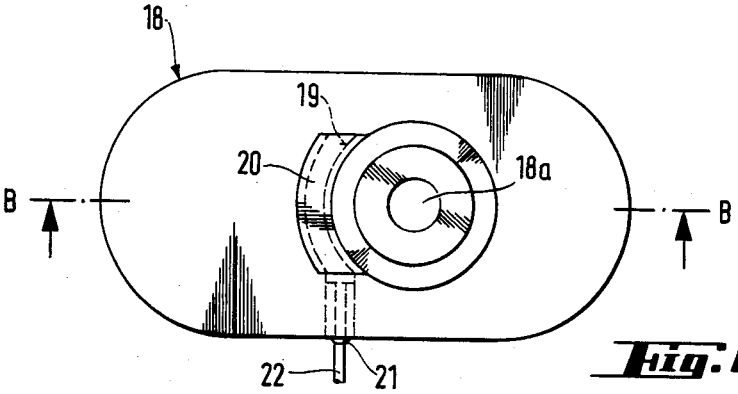
FIG. 6 shows an overhead view of the underside of a valve plate opposite the work surface.

In a further modification, with the valve plate 18 as illustrated in FIGS. 6 and 7, the repository 19 comprises a chamber formed, for example, by molding the plate 18, with an arch-like configuration relative to the flow opening 18*a*, which is closed on its open side facing away from the friction surface 18*b* by a cover 20 attached with refractory cement. The repository has a charging lock 21 with a coupled feed line 22, and can thereby be charged at any time with liquid or gaseous hydrocarbons, for example, tar or methane.

The characteristics of the invention, described above on the basis of wearing refractory parts even though illustrated for linear valves with sliding motion, also apply correspondingly for wearing refractory parts of rotating valves or other valve closures.

It is seen from the foregoing that the invention provides a very novel arrangement in replaceable refractory parts of gate valves which handle molten metal, for minimizing the wear of the refractory parts. Expediently, as described hereinabove, the significant reduction of the wear, and the prolonging of the life of the refractory parts is brought about by ingeniously providing repositories adjacent to vulnerable areas and surfaces of the refractory, where molten metal flows past in contact therewith. The repositories slowly release lubricating agents in the form of hydrocarbons into the vulnerable refractory surfaces where deleterious wear would otherwise occur, and thereby minimize the wear. The repositories may contain replaceable cartridges, or may have a filling lock in the form of a nipple, through which the desired hydrocarbon releasing agent may be injected periodically. By the arrangements described above, the "downtime" of the casting ladle is significantly reduced as compared with prior art arrangements, The invention is not to be taken as limited to all of the details thereof, as modifications and variations of the described arrangements may be made without departing from the spirit and scope of the invention.

What is claimed is:

1. In a metal pouring ladle of the type having a gate valve for stopping flow of molten metal from the ladle in use, said gate valve comprising a refractory body including a passage for flow of molten metal, said refractory body being porous and having wearing surfaces which are prone to depletion and wear by contact with flow of said molten metal, an arrangement to minimize said wear of said refractory surfaces, comprising:

arcuate shaped repository means totally enclosed in and disposed within said refractory body and disposed in proxmity to and oriented toward said wearing surfaces, said repository means having stored therein a supply of liquid heat sensitive impregnation agent which generates protective lubricants which penetrate the refractory pores when heated by said flow of molten metal and which reaches said refractory surfaces from within said repository through refractory body pores at said surfaces, whereby any wear of said refractory surfaces in use is minimized; and means for replenishing said heat sensitive impregnation agent while in a liquid state into said totally enclosed repository means being disposed at least partially in said refractory body; and said means for replenishing including a charging lock which is used to close and seal the repository.

2. The arrangement as in claim 1 wherein said refractory body includes at least first and second members each of which includes at least a portion of said passage, said first and second members being disposed to be capable of relative movement therebetween to shut off said passage for stopping said flow of molten metal, said first and second members having therebetween a frictional contact surface.

3. The arrangement as in claim 2 wherein said arcuate repository means includes at least a first closed arcuate repository disposed in proximity to said passage and a second closed repository disposed in proximity to said frictional contact surface.

4. The arrangement as in claim 3 wherein said charging lock comprises a check valve which is suitable for facilitating inserting said impregnation agent into said repository means.

5. The arrangement as in claim 4, wherein said passage is substantially tubular and said arcuate repository is disposed at least partly conforming to a cross section of said tubular passage.

6. The arrangement as in claim 3 wherein said charging lock comprises a lubricating nipple through which said liquid impregnation agent in the form of a lubricating liquid comprising tar may be introduced into said repository.

7. The arrangement of claim 1, wherein said impregnation agent is of a type which when heated by molten metallic material will emit a hydrocarbon.

8. The arrangement as in claim 7 wherein said repository means has a cavity disposedly oriented toward said passage.

9. The arrangement as in claim 8 wherein said passage for molten metal includes a wall surface, said arrangement including a second repository oriented toward said wall surface.

10. The arrangement as in claim 4 wherein said check valve is suitable for inserting lubricating liquid and gaseous impregnation agents into said cavity.

11. The arrangement as in claim 9 wherein said arcuate shaped repository means includes a cavity at least partly conforming to said wall surface of said passage.

12. The arrangement as in claim 8 wherein said charging lock comprises a lubricating nipple through which said liquid impregnation agent in the form of lubricating liquid may be introduced into said cavity.

* * * * *